US007341251B1

(12) United States Patent
Page

(10) Patent No.: US 7,341,251 B1
(45) Date of Patent: Mar. 11, 2008

(54) PUZZLE GAME APPARATUS AND METHOD

(76) Inventor: Ogden C. Page, 1427 N. Wilcox Ave., Hollywood, CA (US) 90028

( * ) Notice: Subject to any disclaimer, the term of this patent is extended or adjusted under 35 U.S.C. 154(b) by 64 days.

(21) Appl. No.: 11/355,350

(22) Filed: Feb. 17, 2006

(51) Int. Cl.
*A63F 9/08* (2006.01)

(52) U.S. Cl. ..... 273/155

(58) Field of Classification Search ..... 273/155, 273/153 R, 157 R; D21/478, 480; 446/488; 428/542.6
See application file for complete search history.

(56) References Cited

U.S. PATENT DOCUMENTS

| | | | | | |
|---|---|---|---|---|---|
| 1,642,901 | A * | 9/1927 | Srofe | 446/85 |
| 2,007,421 | A * | 7/1935 | Coughlin | 446/488 |
| 2,400,241 | A * | 5/1946 | Linden | 172/375 |
| 2,680,935 | A | 6/1954 | Smart | |
| 2,898,110 | A * | 8/1959 | Overbaugh | 473/388 |
| 3,785,066 | A * | 1/1974 | Tuitt | 434/403 |
| 3,859,897 | A | 1/1975 | Higa | |
| 4,366,961 | A * | 1/1983 | Busse | 273/155 |
| 4,465,467 | A * | 8/1984 | Exelby | 434/172 |
| 4,517,251 | A * | 5/1985 | Mosely | 428/542.8 |
| 5,010,669 | A * | 4/1991 | Moran | 40/539 |
| 5,299,804 | A | 4/1994 | Stevens | |
| 5,338,034 | A | 8/1994 | Asch | |
| 5,445,380 | A * | 8/1995 | Polsky | 273/155 |
| 5,564,704 | A * | 10/1996 | Yang | 273/155 |
| 5,853,336 | A * | 12/1998 | Hufgard | 473/282 |
| D413,361 | S | 8/1999 | Silvey | |
| 6,264,199 | B1 | 7/2001 | Schaedel | |
| 6,523,826 | B1 * | 2/2003 | Matos | 273/155 |

* cited by examiner

*Primary Examiner*—Steven Wong

(57) ABSTRACT

A puzzle game apparatus includes a substantially rigid game piece including a first plate, a second plate and a third plate. Each of the first, second and third plates has a bottom edge, a top edge, a first lateral edge and a second lateral edge. The top edge of the first and second plates are attached to each other. A bottom edge of the third plate is attached to and extends upwardly from the top edges of the first and second plates. The first plate has a first slot therein. The second plate has a second slot therein extending. A flexible panel has a substantially rectangular shape. A cutting tool is provided and is used for cutting the flexible panel into a plurality of flaps so that the flaps can be bent with respect to each other to mimic an appearance of the game piece.

4 Claims, 4 Drawing Sheets

PUZZLE GAME APPARATUS AND METHOD

BACKGROUND OF THE INVENTION

1. Field of the Invention

The present invention relates to puzzle game devices and more particularly pertains to a new puzzle game device for providing a folding game wherein a player attempts to recreate the appearance of a provided game piece structure.

2. Description of the Prior Art

The use of puzzle game devices is known in the prior art. While these devices fulfill their respective, particular objectives and requirements, the need remains for a device and method wherein a person is required to cut and bend portions of a panel to form the shape of a provided game piece.

SUMMARY OF THE INVENTION

The present invention meets the needs presented above by generally comprising a substantially rigid game piece including a first plate, a second plate and a third plate. Each of the first, second and third plates has a bottom edge, a top edge, a first lateral edge and a second lateral edge. The top edge of the first and second plates are attached to and coextensive with each other. A bottom edge of the third plate is attached to and extends upwardly from a juncture of the top edges of the first and second plates. The first plate has a first slot therein extending upwardly from the bottom edge and to the top edge of the first plate. The second plate has a second slot therein extending upwardly from the bottom edge to the top edge of the second plate. A flexible panel has a substantially rectangular shape. A cutting tool is provided and is used for cutting the flexible panel into a plurality of flaps so that the flaps can be bent with respect to each other to mimic an appearance of the game piece.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
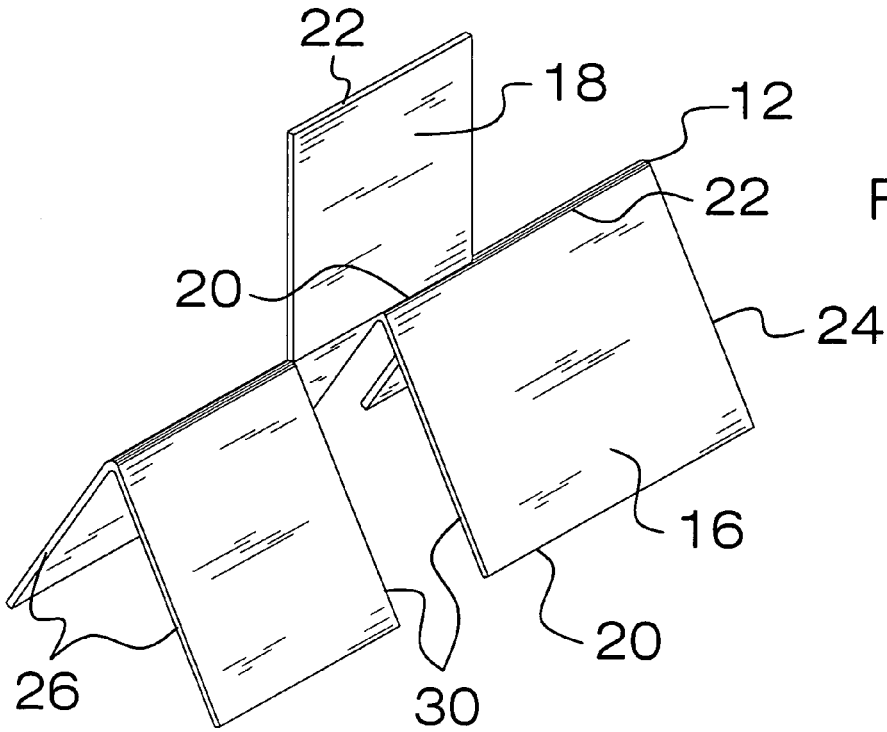
FIG. 1 is a front perspective view of a game piece of a puzzle game apparatus and method according to the present invention.
Figure 2:
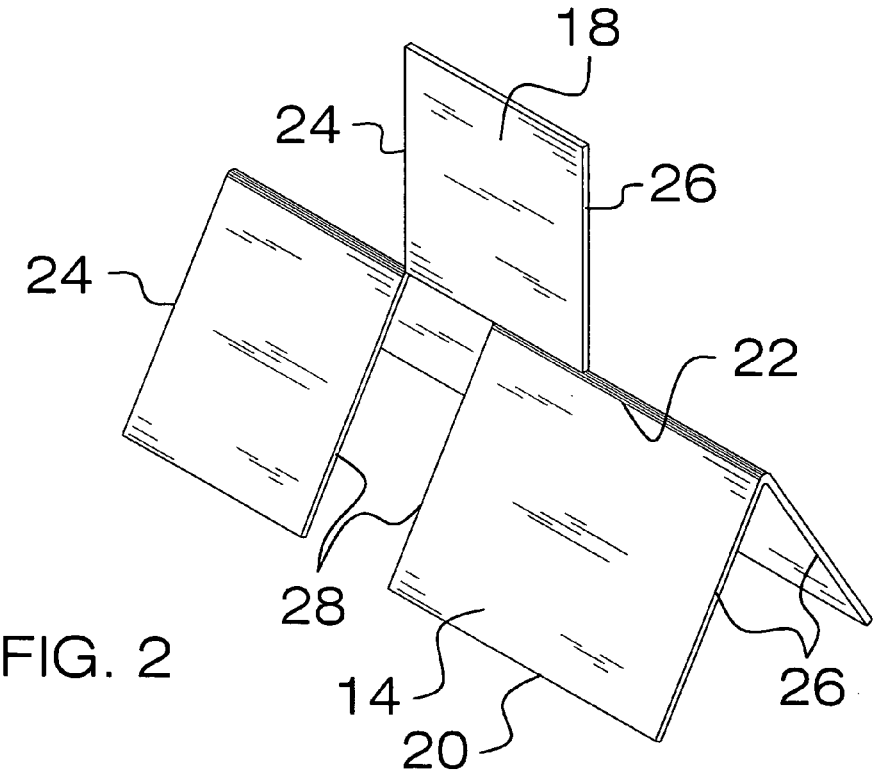
FIG. 2 is a rear perspective view of the game piece of the present invention.
Figure 3:
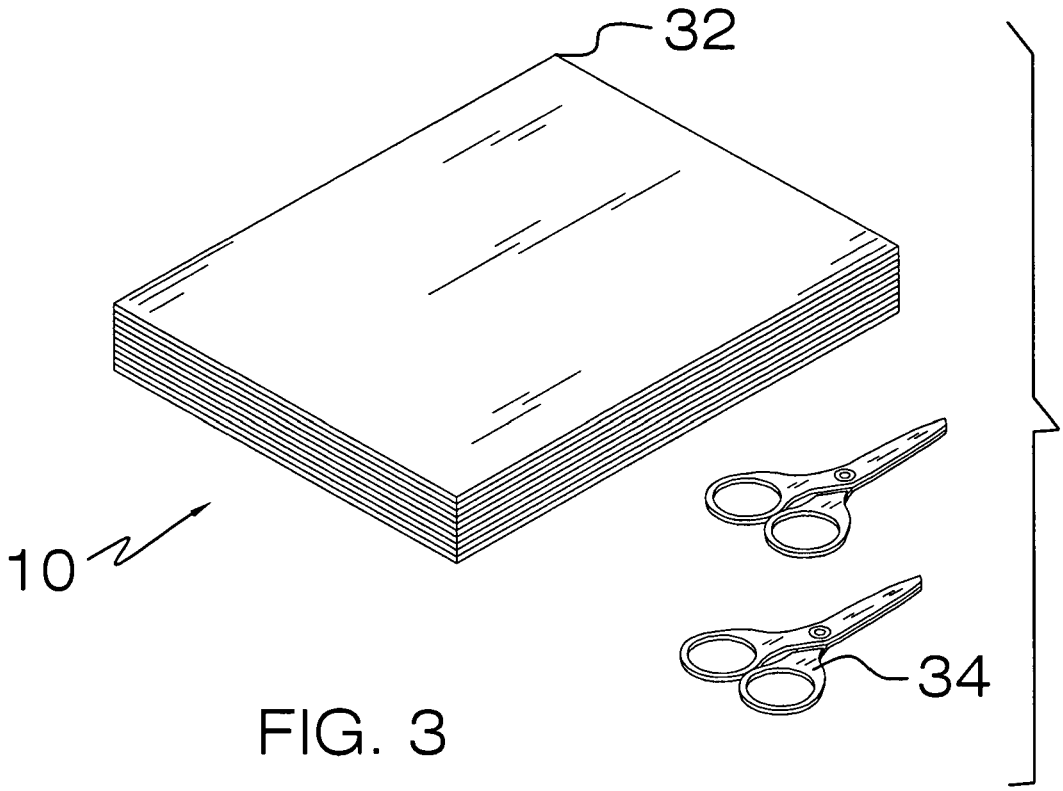
FIG. 3 is a perspective view of panels of the present invention.

With reference now to the drawings, and in particular to FIGS. 1 through 9 thereof, a new puzzle game device embodying the principles and concepts of the present invention and generally designated by the reference numeral 10 will be described.

As best illustrated in FIGS. 1 through 9, the puzzle game apparatus and method 10 generally comprises providing a substantially rigid game piece 12 that includes a first plate 14, a second plate 16 and a third plate 18. Each of the first 14, second 16 and third 18 plates has a bottom edge 20, a top edge 22, a first lateral edge 24 and a second lateral edge 26. The top edge 22 of the first 14 and second plates 16 is attached to and coextensive with each other. The first 24 and second 26 lateral edges of the first plate 14 are aligned with a corresponding one of the first 24 and second 26 lateral edges of the second plate 16. An angle formed between the first 14 and second 16 plates is substantially between 45 degrees and 90 degrees.

A bottom edge 20 of the third plate 18 is attached to and extends upwardly from a juncture of the top edges 22 of the first 14 and second 16 plates. The third plate 18 is positioned between the first 24 and second 26 lateral edges of the first 14 and second 16 plates. An angle between the first plate 14 and the third plate 18 is substantially equal to an angle between the second plate 16 and the third plate 18. The first plate 14 has a first slot 28 therein extending upwardly from the bottom edge 20 and to the top edge 22 of the first plate 14. The second plate 16 has a second slot 30 therein extending upwardly from the bottom edge 20 to the top edge 22 of the second plate 16. The first slot 28 extends along the bottom edge 20 of the third plate 18 from the first lateral edge 24 of the third plate 18 and substantially half a distance to the second lateral edge 26 of the third plate 18. The second slot 30 extends along the bottom edge 20 of the third plate 18 from the second lateral edge 26 of the third plate 18 and substantially half a distance to the first lateral edge 24 of the third plate 18.

A flexible panel 32 is provided which has a substantially rectangular shape. The flexible panel 32 is preferably comprised of a sheet of paper or cardboard material. A cutting tool 34 is provided for cutting the flexible panel 32 as desired. The cutting tool 34 is preferably a pair of scissors.

Figure 4:
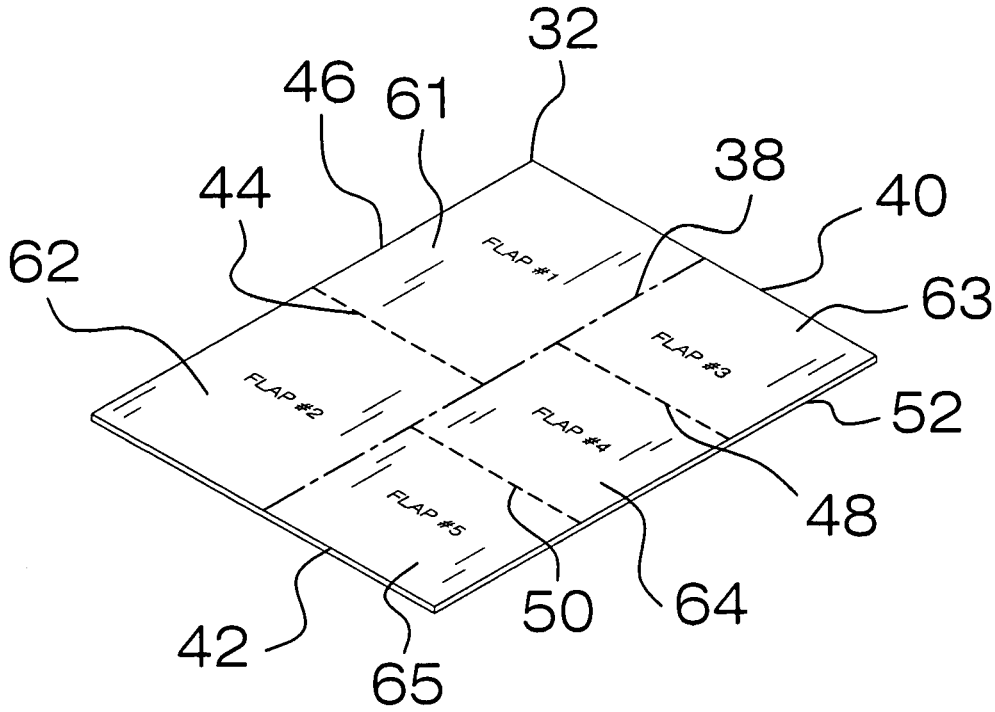
FIG. 4 is a perspective view of a panel of the present invention.
Figure 5:
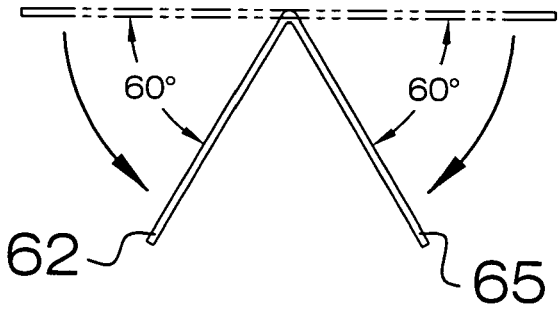
FIG. 5 is an end view of the present invention.
Figure 6:
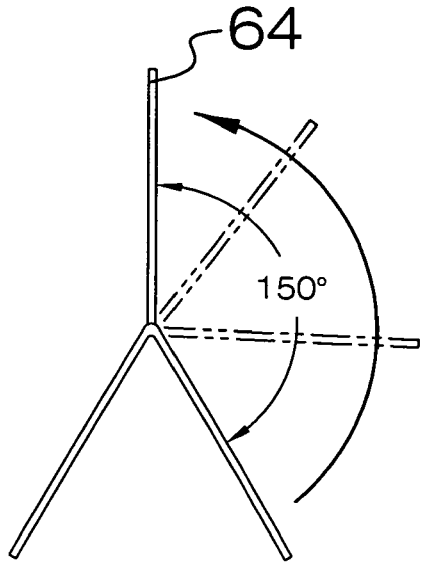
FIG. 6 is an end view of the present invention.
Figure 7:
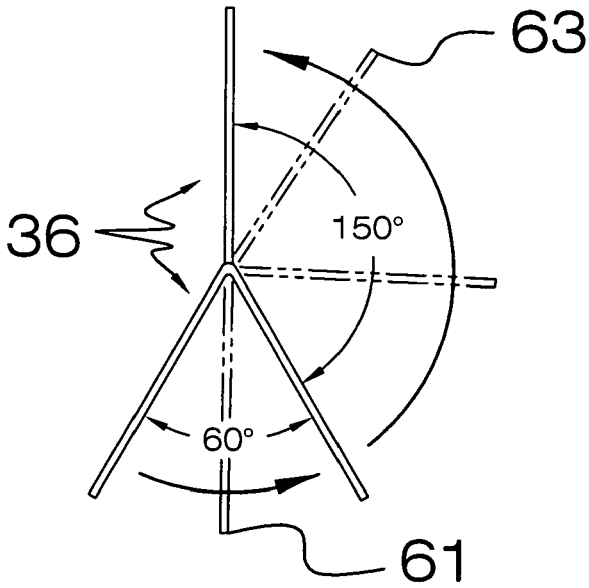
FIG. 7 is an end view of the present invention.
Figure 8:
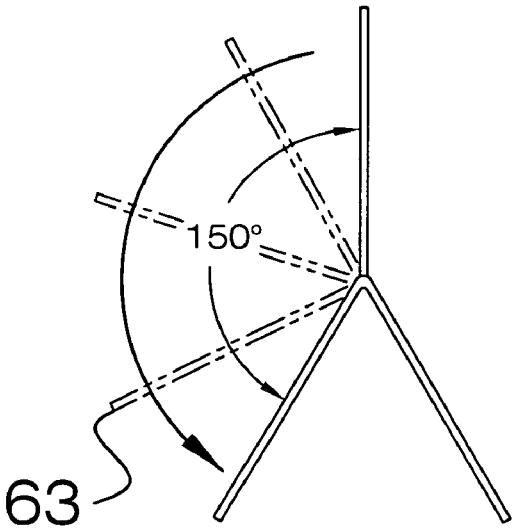
FIG. 8 is an end view of the present invention.
Figure 9:
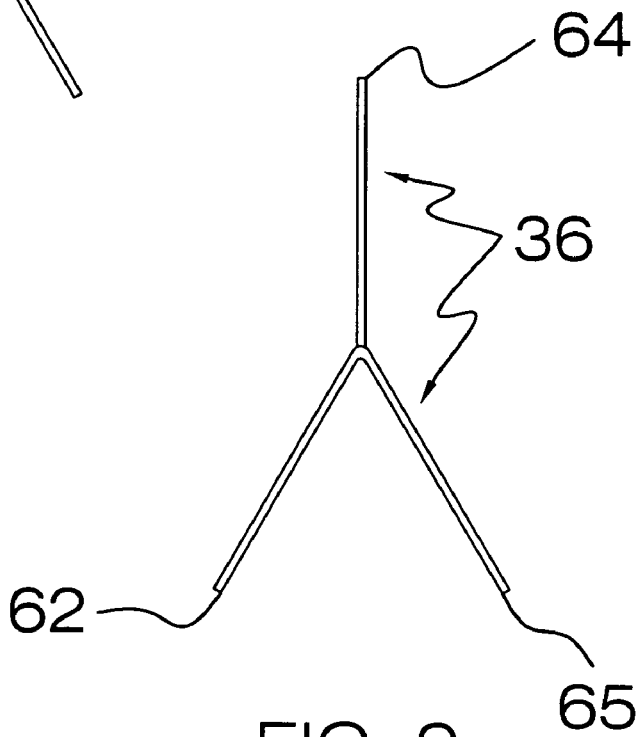
FIG. 9 is an end view of the present invention.

The flexible panel 32 is cut into a plurality of flaps 36 and the flaps 36 are then bent with respect to each other to mimic an appearance of the game piece 12. The steps of cutting the flexible panel 32 into a plurality of flaps 36 and bending the flaps 36 are shown in FIGS. 5-9. FIG. 4 includes indicia for explanation purposes but which will not be placed on the panel 32 when it is actually used.

The first step is to define a dividing line 38 extending from a first end edge 40 to a second end edge 42 of the panel 32. A first cut 44 is made in the panel 32 from a first lateral edge 46 to the dividing line 38 to define a first flap 61 and a second flap 62. The first 61 and second 62 flaps have a substantially equal width.

A second cut 48 and a third cut 50 are made in the panel 32 from a second lateral edge 52 to the dividing line 38 to define a third flap 63, a fourth flap 64 and a fifth flap 65. The fourth flap 65 is positioned between the third and fifth flaps.

The second cut 48 is between the first cut 44 and the first end edge 40 and the third cut 50 is between the first cut 44 and the second end edge 42.

The panel 32 is bent along the folding line 38 to form an angle equal to about 60 degrees. The fourth flap 64 is rotated about 150 degrees and the third flap 63 is also rotated about 150 degrees to be about coplanar with the fourth flap 64. The first flap 61 is then rotated about 60 degrees to be about coplanar with the fifth flap 65 and the third flap 63 is rotated about 150 degrees to be about coplanar with the second flap 62 so that the panel 32 forms the shape shown by the game piece 12. By rotation it should be understand that the flaps 36 are being bent or rotated with respect to each other.

The game apparatus and method 10 may be played alone or a plurality of panels 32 and cutting members 34 may be provided so that a plurality of players may play against each other. When a plurality of players attempts to solve the game apparatus, a player wins by being the first to mimic the shape of the game piece 12 with the panel 32.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a puzzle game comprising the steps of:

providing a substantially rigid game piece including a first plate, a second plate and a third plate, each of said first, second and third plates having a bottom edge, a top edge, a first lateral edge and a second lateral edge, said top edge of said first and second plates being attached to and coextensive with each other, a bottom edge of said third plate being attached to and extending upwardly from a juncture of said top edges of said first and second plates, said first plate having a first slot therein extending upwardly from said bottom edge and to said top edge of said first plate, said second plate having a second slot therein extending upwardly from said bottom edge to said top edge of said second plate, said first and second lateral edges of said first plate being aligned with a corresponding one of said first and second lateral edges of said second plate, an angle formed between said first and second plates being substantially between 45 degrees and 90 degrees, said third plate being positioned between said first and second lateral edges of said first and second plates, said first slot extending along said bottom edge of said third plate from said first lateral edge of said third plate and substantially half a distance to said second lateral edge of said third plate, said second slot extending along said bottom edge of said third plate from said second lateral edge of said third plate and substantially half a distance to said first lateral edge of said third plate;

providing a flexible panel having a substantially rectangular shape;

providing a cutting tool; and cutting said flexible panel into a plurality of flaps and bending said flaps with respect to each other to mimic an appearance of said game piece.

2. The method according to claim 1, wherein said step of cutting said flexible panel into a plurality of flaps and bending said flaps includes the steps of:

defining a dividing line extending from a first end edge to a second end edge of said panel;

making a first cut in said panel from a first lateral edge to said dividing line to define a first flap and a second flap, said first and second flaps having a substantially equal width;

making a second cut and a third cut in said panel from a second lateral edge to said dividing line to define a third flap, a fourth flap and a fifth flap, wherein said fourth flap is positioned between said third and fifth flaps, said second cut being between said first cut and said first end edge and said third cut being between said first cut and said second end edge;

bending said panel and said panels until said second and third flaps are coplanar, said first and fifth flaps are coplanar, said second and fifth flaps form an angle equal to about 60 degrees, and an angle between said fourth and fifth flaps is equal to about 150 degrees.

3. The method according to claim 1, wherein said step of cutting said flexible panel into a plurality of flaps and bending said flaps includes the steps of:

defining a dividing line extending from a first end edge to a second end edge of said panel;

making a first cut in said panel from a first lateral edge to said dividing line to define a first flap and a second flap, said first and second flaps having a substantially equal width;

making a second cut and a third cut in said panel from a second lateral edge to said dividing line to define a third flap, a fourth flap and a fifth flap, wherein said fourth flap is positioned between said third and fifth flaps, said second cut being between said first cut and said first end edge and said third cut being between said first cut and said second end edge;

bending said panel along said folding line to form an angle equal to about 60 degrees;

rotating said fourth flap about 150 degrees;

rotating said third flap about 150 degrees to be about coplanar with said fourth flap;

rotating said first flap about 60 degrees to be about coplanar with said fifth flap; and rotating said third flap about 150 degrees to be about coplanar with said second flap.

4. A method of playing a puzzle game comprising the steps of:

providing a substantially rigid game piece including a first plate, a second plate and a third plate, each of said first, second and third plates having a bottom edge, a top edge, a first lateral edge and a second lateral edge, said top edge of said first and second plates being attached to and coextensive with each other wherein said first and second lateral edges of said first plate are aligned with a corresponding one of said first and second lateral edges of said second plate, an angle formed between said first and second plates being substantially between 45 degrees and 90 degrees, a bottom edge of said third plate being attached to and extending upwardly from a juncture of said top edges of said first and second plates, said third plate being positioned between said first and second lateral edges of said first and second plates, an angle between said first plate and said third plate being substantially equal to an angle between said second plate and said third plate, said first plate having a first slot therein extending upwardly from said bottom edge and to said top edge of said first plate, said second plate having a second slot therein extending upwardly from said bottom edge to said top edge of said second plate, said first slot extending along said bottom edge of said third plate from said first lateral edge of said third plate and substantially half a distance to said second lateral edge of said third plate, said second slot extending along said bottom edge of said third plate from said second lateral edge of said third plate and substantially half a distance to said first lateral edge of said third plate;

providing a flexible panel having a substantially rectangular shape;

providing a cutting tool;

cutting said flexible panel into a plurality of flaps and bending said flaps with respect to each other to mimic an appearance of said game piece, wherein said step of cutting said flexible panel into a plurality of flaps and bending said flaps includes the steps of;

defining a dividing line extending from a first end edge to a second end edge of said panel;

making a first cut in said panel from a first lateral edge to said dividing line to define a first flap and a second flap, said first and second flaps having a substantially equal width;

making a second cut and a third cut in said panel from a second lateral edge to said dividing line to define a third flap, a fourth flap and a fifth flap, wherein said fourth flap is positioned between said third and fifth flaps, said second cut being between said first cut and said first end edge and said third cut being between said first cut and said second end edge;

bending said panel along said folding line to form an angle equal to about 60 degrees;

rotating said fourth flap about 150 degrees;

rotating said third flap about 150 degrees to be about coplanar with said fourth flap;

rotating said first flap about 60 degrees to be about coplanar with said fifth flap; and rotating said third flap about 150 degrees to be about coplanar with said second flap.

* * * * *